US010309743B2

(12) United States Patent
Rami

(10) Patent No.: US 10,309,743 B2
(45) Date of Patent: Jun. 4, 2019

(54) TRIGGERING MECHANISM FOR HYBRID PRIMER CARTRIDGES

(71) Applicant: Shyam Swaminadhan Rami, Kerla (IN)

(72) Inventor: Shyam Swaminadhan Rami, Kerla (IN)

( * ) Notice: Subject to any disclaimer, the term of this patent is extended or adjusted under 35 U.S.C. 154(b) by 0 days.

(21) Appl. No.: 15/968,224

(22) Filed: May 1, 2018

(65) Prior Publication Data

US 2018/0328688 A1 Nov. 15, 2018

Related U.S. Application Data

(60) Provisional application No. 62/506,164, filed on May 15, 2017.

(51) Int. Cl.

| | |
|---|---|
| ***F41A 21/00*** | (2006.01) |
| ***F41A 19/59*** | (2006.01) |
| ***F42C 19/08*** | (2006.01) |
| ***F41A 21/12*** | (2006.01) |
| ***F41A 19/69*** | (2006.01) |
| ***F41A 3/30*** | (2006.01) |

(Continued)

(52) U.S. Cl.

CPC ..... *F41A 19/59* (2013.01); *F41A 3/26* (2013.01); *F41A 3/30* (2013.01); *F41A 19/69* (2013.01); *F41A 19/70* (2013.01); *F41A 21/12* (2013.01); *F42C 19/0834* (2013.01)

(58) Field of Classification Search

CPC ..... F41A 19/58; F41A 19/59; F41A 19/69

See application file for complete search history.

(56) References Cited

U.S. PATENT DOCUMENTS 2,466,929 A * 4/1949 Catlin ..... F41A 19/58 89/135
3,431,816 A * 3/1969 Dale ..... F41A 19/58 124/3
3,748,770 A 7/1973 Mitchell
(Continued)

*Primary Examiner* — Gabriel J. Klein
(74) *Attorney, Agent, or Firm* — Law Offices of Steven W. Weinrieb

(57) ABSTRACT

Methods to trigger the Hybrid primer cartridge in electro-mechanical and full electric mode using modified locking chamber with electric power contacts that can supply the modified bolt with very high-voltage electric power supply where the contacts are sufficiently insulated to avoid any leakage. Modified bolt with power contacts on the locking lugs such that when in locked position it can receive power from the chamber's power supply contacts and apply the electric power to the electrode pins of the hybrid primer through the contacts on the face of the bolt. An electric switch that is controlled by the movement of the hammer or striker converting the mechanical movement to simultaneously control the electrical triggering of the primer thereby eliminating need for microprocessor or microcontroller units. A hybrid hammer device which has high-voltage power pulse supply and return contact points surrounded with adequate electrical insulation wherein one of the contacts may be such that it acts like an electrical switch which will be closed when the hammer strikes the hybrid firearm firing pin and bolt. A bolt which can receive the power from the hybrid hammer through the contacts in the aft or through the insulated firing pin contacts.

7 Claims, 9 Drawing Sheets

(51) Int. Cl.
*F41A 3/26* (2006.01)
*F41A 19/70* (2006.01)

(56) References Cited

U.S. PATENT DOCUMENTS

| | | | | | |
|---|---|---|---|---|---|
| 5,235,129 | A * | 8/1993 | Corney | F41A 19/69 | 102/472 |
| 5,329,840 | A | 7/1994 | Corney | | |
| 5,735,070 | A * | 4/1998 | Vasquez | F41A 9/62 | 42/1.02 |
| 5,755,056 | A | 5/1998 | Danner et al. | | |
| 6,332,402 | B1 * | 12/2001 | Weise | F42B 5/08 | 102/202.5 |
| 9,546,857 | B2 * | 1/2017 | Rami | F42C 19/0834 | |
| 2005/0241203 | A1 * | 11/2005 | Lizotte | F41A 21/12 | 42/1.01 |

* cited by examiner

TRIGGERING MECHANISM FOR HYBRID PRIMER CARTRIDGES

BACKGROUND OF THE INVENTION

The present invention is in the technical field of firearms. More particularly, the present invention is in the technical field of electronic and electro-mechanical triggering mechanism used in handheld or mounted gun systems.

Conventional firearm's triggering mechanism (such as those used in the handheld or mounted gun) largely use only mechanical power to strike on the percussion cup in the centerfire cartridges.

Few conventional guns do use electrical power applied using the firing pin or fixed electrode on the face of the bolt to central percussion cup primer. Systems for electrically igniting the propellant charge in gun-fired ammunition have long been known in the prior art. For example, the U.S. Pat. No. 3,748,770 describes one such arrangement where the bolt consists of a fixed central firing pin acting as a power contact to fire the primer having an electrically conductive priming mixture in the percussion cup. This system cannot be used to fire the electrodes of a Hybrid primer because they are not located inside the percussion cup but are arranged in an insulated base around it. Similar to the U.S. Pat. No. 3,748,770 there are other patents (for example, U.S. Pat. No. 5,755,056A) which aim to trigger the centrally located primer in percussion cup using energized firing pin. In U.S. Pat. No. 5,329,840 the FIG. 1 explains the working of such systems.

These firearms however do not have the triggering mechanism to fire the Hybrid Primer cartridges since applying the electric power to the percussion cup in a Hybrid primer will not energize the electrodes around it which are the key to achieve multiple triggering points within the cartridge case. The Hybrid Primer referred here is a new patented primer design (U.S. Pat. No. 9,546,857) which consists of a centrally located conventional pressure-sensitive chemical primer housed in a percussion cup surrounded by electrical primer consisting of insulating base housing multiple electrode pins of varying lengths housed in the holes or slots in the base (similar to bristles of a tooth-brush). When high-voltage electrical pulses are applied on these electrodes then the plasma or electric arcs are generated at multiple points along the length of the cartridge burning the propellant efficiently.

SUMMARY OF THE INVENTION

The present invention discusses in detail the multiple ways to trigger the Hybrid primer in a firearm either by turning the set of electrode pins as a pair to generate the plasma i.e., electric arc between them (two-wire system) or to convert the cartridge case itself as one of the electrode and the electrode pins as the electrode of opposite polarity (one-wire system). The present invention is an enhancement of the conventional firearm like single barrel or multi-barrel firearm or grenade launcher etc., with modified chamber, bolt and switches activated by trigger or hammer or a combination of the mentioned components (with or without microprocessor/microcontroller unit and associated sensors or position encoders). The electric power is supplied through the chamber and passed to the bolt when in locked position however the current flow is controlled by the switched activated by the hammer/striker. Also discussed here is an alternate way to use a modified hammer and firing pin combination as part of electrical circuit which can fire the Hybrid primer cartridge through the application of high-voltage electric power pulses to the modified bolt or just the striker to directly apply the electrical power on the Hybrid primer. These modified components, individually or as a combination, enable the firearm to be fired in three modes (with respect to the functioning of firearm): the conventional mechanical mode, electro-mechanical/hybrid mode and the electric only mode. With respect to the triggering of the Hybrid primer cartridge these modes can be classified as the conventional chemical-primer mode, the hybrid-primer mode and the electric-primer mode. This application further details the solutions on how to upgrade various components like the chamber, bolt, hammer, firing-pin, trigger etc., in the conventional firearms economically so that they can fire the cartridges employing the Hybrid Primer.

BRIEF DESCRIPTION OF THE DRAWING

FIG. 1(*c*) shows the bolt's power supply input contacts, the insulated connecting electrical wires and the contacts on the face of the bolt as part of the two-wire system and 1(*d*) shows the contacts on the bolt face applying electric power to the hybrid primer base;

FIG. 3(*c*) shows the hybrid hammer which can allow the electric power pulses through it when its contacts are pressed against the contacts on the bolt or alternately through the firing-pin.

DETAILED DESCRIPTION OF THE INVENTION

Figure 1A:
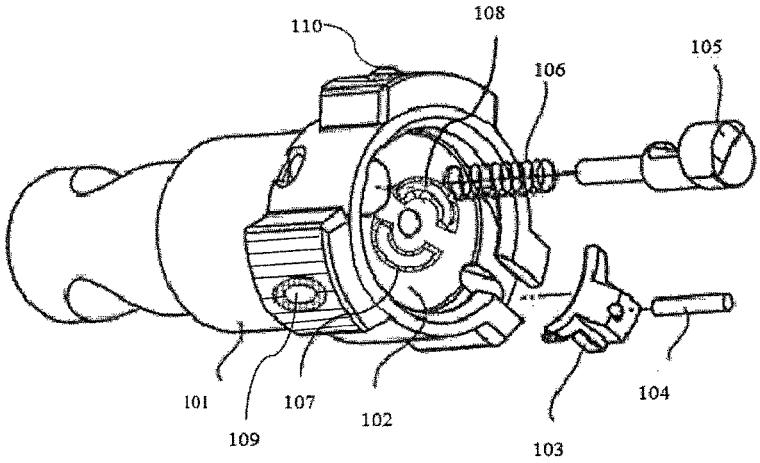
FIGS. 1(*a*) and (*b*) are perspective views of the hybrid bolt which can supply very high-voltage low-current electric pulses to the Hybrid primer's electrodes through the power contacts on its lugs to the contacts on the face of the bolt connected via insulated wires. The bolt also allows the chemical primer to be triggered mechanically using the firing pin.
Figure 1B:
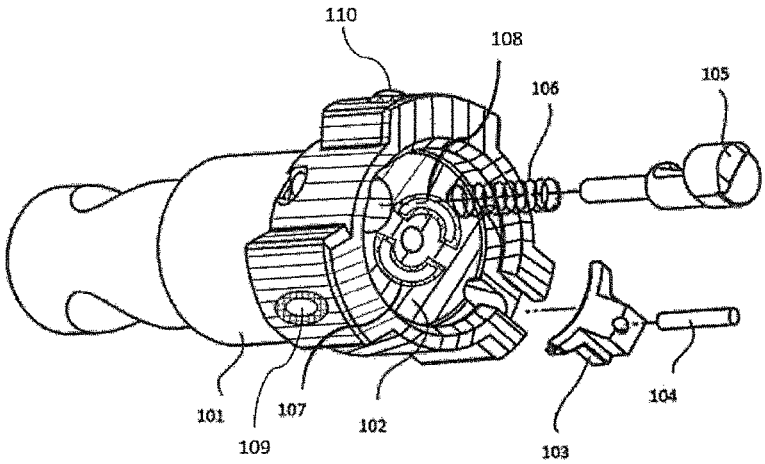
Figure 1C:
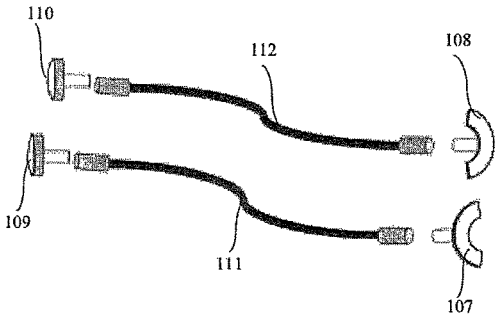
Figure 1D:
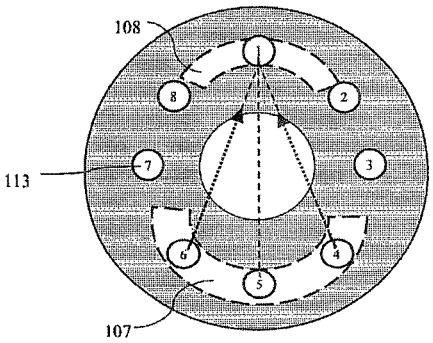
Figure 2A:
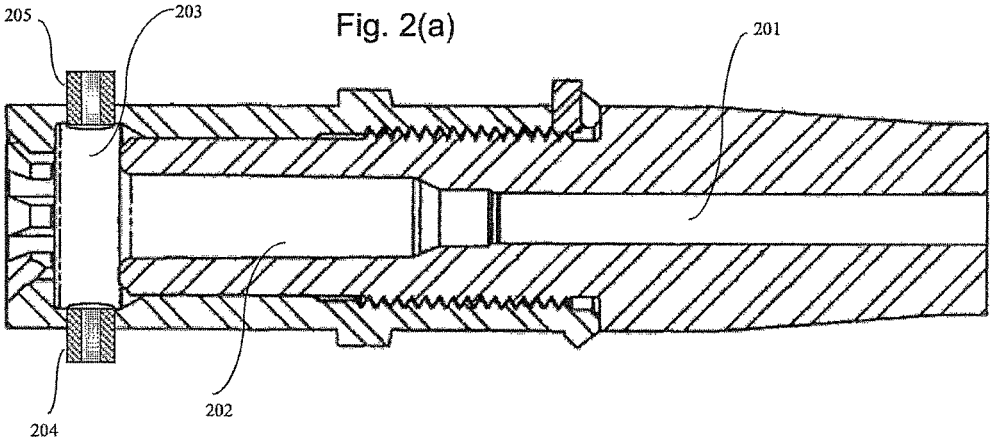
FIGS. 2(*a*), (*b*), (*c*) and (*d*) shows the barrel-chamber with the locking chamber modified such that electric power pulses can be supplied to the primer via the bolt when it is in the locked position in the chamber.
Figure 2B:
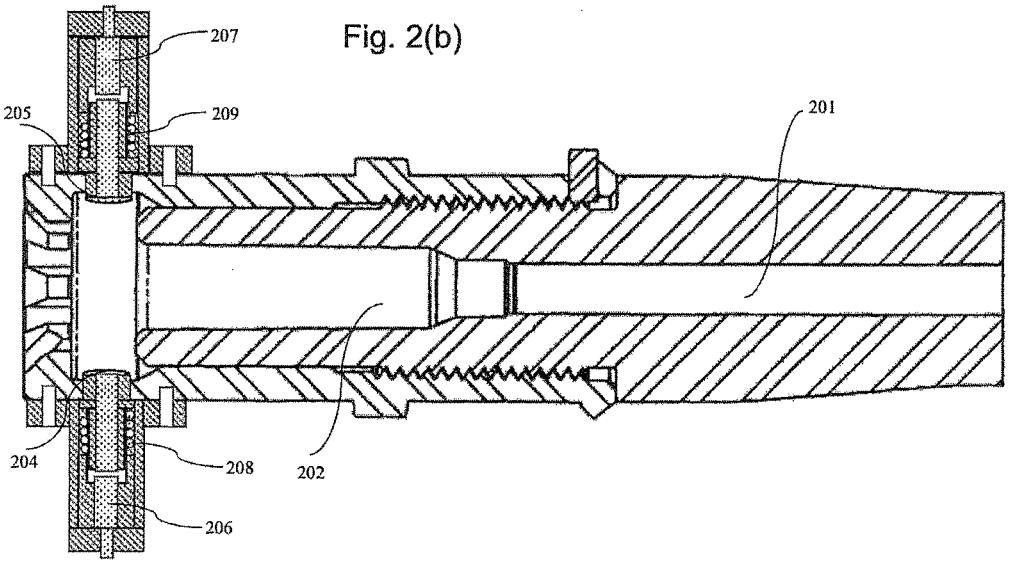
Figure 2C:
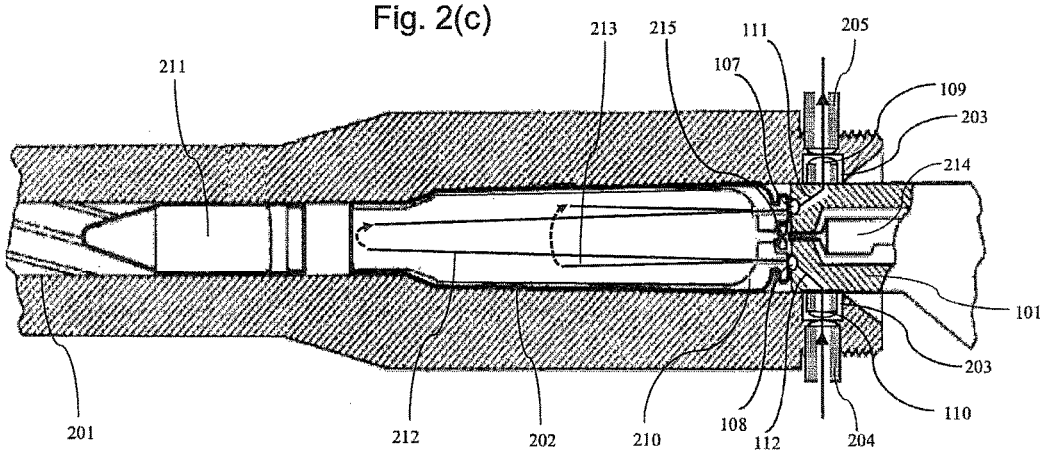
Figure 2D:
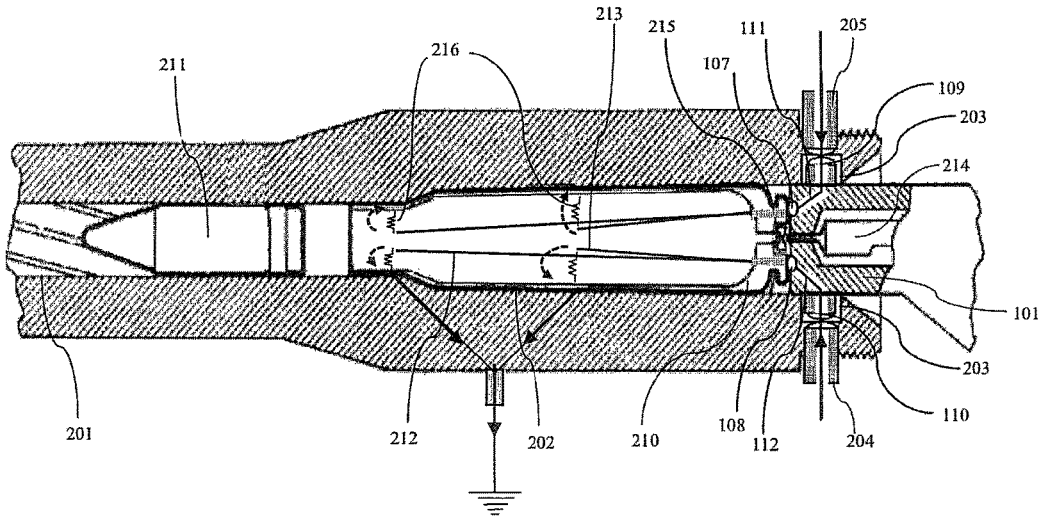

Referring now to the invention in more detail, in FIG. 1(*a*) is shown the bolt which is modified to receive the high-voltage electric pulses through contact points (109, 110) on the bolt's locking lugs. When the bolt is in the locked position it will receive the electrical power via the contacts in the chamber and transfers it to the Hybrid primer through the contacts (107, 108) on the face of the bolt; wherein the contacts on the face of the bolt and those on the lugs are connected by insulated wires or bus. The locking lugs may be detachable from the bolt and made of material which has high heat and electrical resistance or may be covered by one or more layers of electrical and heat resistant insulating tapes. The contact points are surrounded with sufficient thickness of electrical insulation so that the electric current does not leak to the bolt or other parts of the firearm.

The front portion of the bolt or the whole bolt itself may be made with materials that can resist the very high-voltage low-current power supply as well as be capable of resisting heat and withstand high pressure (like polyamide polymers, fiber-glass, ceramics, nylon 66 based composite compounds, etc.); FIG. 1(*b*) shows one such design where front of the bolt is made using an insulated material (shown in shaded pattern).

FIG. 1(*c*) shows the lug contact points (109 and 110) connected to the primer contact points (107 and 108) connected using the insulated electrical wires (111 and 112).

In a two-wire system the distance between the power contacts on the face of the bolt (107 and 108) is greater than the diameter (or width) of the primer's electrode base contact points to prevent short circuit. In FIG. 1(*d*) a representative diagram of primer base is shown where the hybrid primer's electrode pin base contacts are shown in circles (in an 8 pin configuration) arranged in a circular plane equidistant from each other; each of the bolt's primer contacts 107 and 108 are designed to contact at least one of these electrodes. The plasma or electric arc is shown originating from electrodes 4, 6 and also 5 (which are in contact with the bolt's power contact point 107) and ending at the electrode 1 (which is in contact with 108 power contact point on the bolt).

FIG. 2(*a*) shows a chamber modified to have power supply contacts (204 and 205) fixed on the locking section (203) of the chamber such that when the bolt is in the locked position the bolt will contact the power points thus completing the electric circuit when the trigger is pulled, allowing the current from the application high-voltage electric power pulses to flow from the supply to the primer.

Applying electric power through the locking chamber and bolt instead of the firing-pin allows the manufacturers to design the firearm to fire in pure electrical mode minimizing the mechanical vibrations resulting in improved accuracy.

FIG. 2(*b*) shows another example of chamber supplying electric power but with moving power contact parts. The chamber contacts 204 and 205 are movable parts which will be pushed out by the locking lugs when the bolt is in locked position; these contacts will then come in contact with the fixed contact points 206 and 207 respectively; hence the current flows through the contacts when the electric circuit is completed. When the bolt is unlocked, the contacts return to the original position pushed by the springs (208 and 209).

FIG. 2(*c*) shows the chamber (202) loaded with a Hybrid primer cartridge 212 and is locked into position by a bolt (101). The bolt (101) consists of the firing pin (214) which triggers the chemical primer in percussion cup (215) using mechanical strike applied by a hammer. The bolt shown in this figure is in locked position with its locking lugs having the electrical contact points 109 and 110 pressed against the locking chamber's electrical supply points 205 and 204 respectively which completes the electrical circuit when the trigger switch is closed i.e., switched ON. When the electrical power pulse is applied through the locking chamber supply contact (204), the current travels through the locking lug's contact 110, the connecting wire 112 and is then applied to the electric primer's long and short electrode pin pairs (212 and 213) via contact 108; the current jumps in the form of plasma channel or spark created between the anode and cathode electrode pins and then returns through the contact point 107, the connecting wire 111, locking lug contact point 109 and returns to the electrical ground or terminal point through the chamber's contact 205. When the trigger is squeezed, an electrical switch called the 'Trigger switch' or a switch controlled by hammer movement called 'Hammer Switch' will be closed which allows the flow of electric current to the chamber.

To control the rate of fire in the firearm (like single burst, three burst or full automatic mode etc.), without any mechanical movement of the hammer and firing-pin, a microcontroller/microprocessor based electronic control system may be used which can sense user inputs like the position of the trigger, the selector and also sense the position of the bolt which can then be used to control a solid state electronic switch which in turn controls the application of electric power to the primer.

FIG. 2(*d*) shows the firearm in 'one-wire setting' where the bolt applies the same electric polarity through its contacts on the primer and the conducting chamber-barrel assembly is connected to the ground or returning point of the electrical circuit. When power is applied to the Hybrid primer electrodes via the bolt contact point, the electrons jump from the electrodes to the conducting cartridge case (forming the electric arc) and return via the chamber completing the circuit (or vice versa based on polarity of the power applied). The primer electrodes pins are arranged such that the electrical resistance at the gaps (216) of long & short pins and the cartridge case allow current to flow equally through all the points so that electrons can jump from the pins to the case creating the plasma which will burn the propellant. The cartridge case acts as one of the electrode hence the distance between the short pins and case is greater than the distance between the longer pins and the case such that equal currents flow through long and the short pin paths.

Figure 3A:
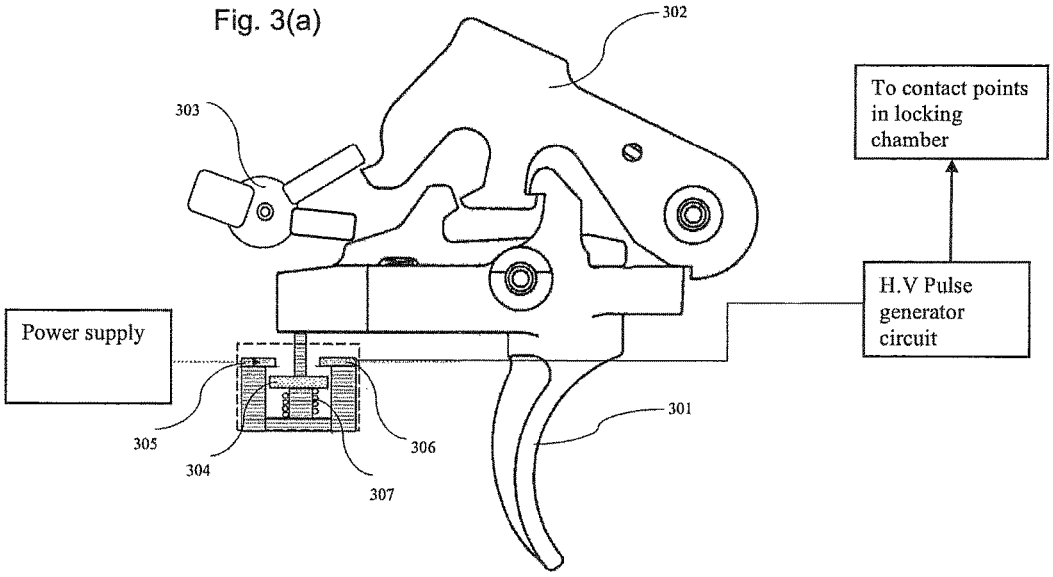
FIGS. 3(*a*) and (*b*) show how the trigger and the hammer can be used to control the electrical trigger.
Figure 3B:
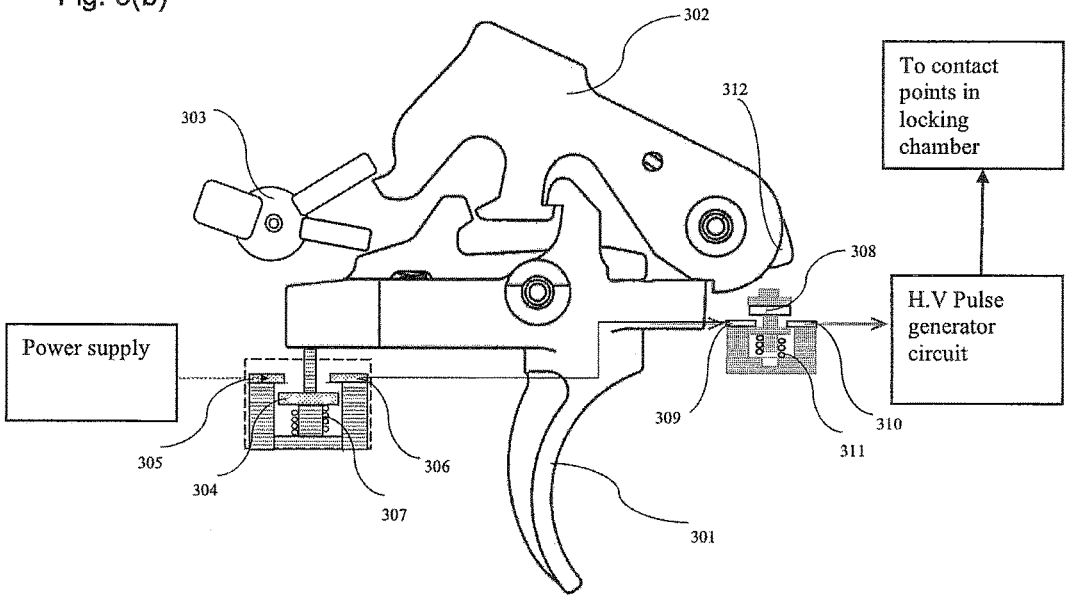
Figure 3C:
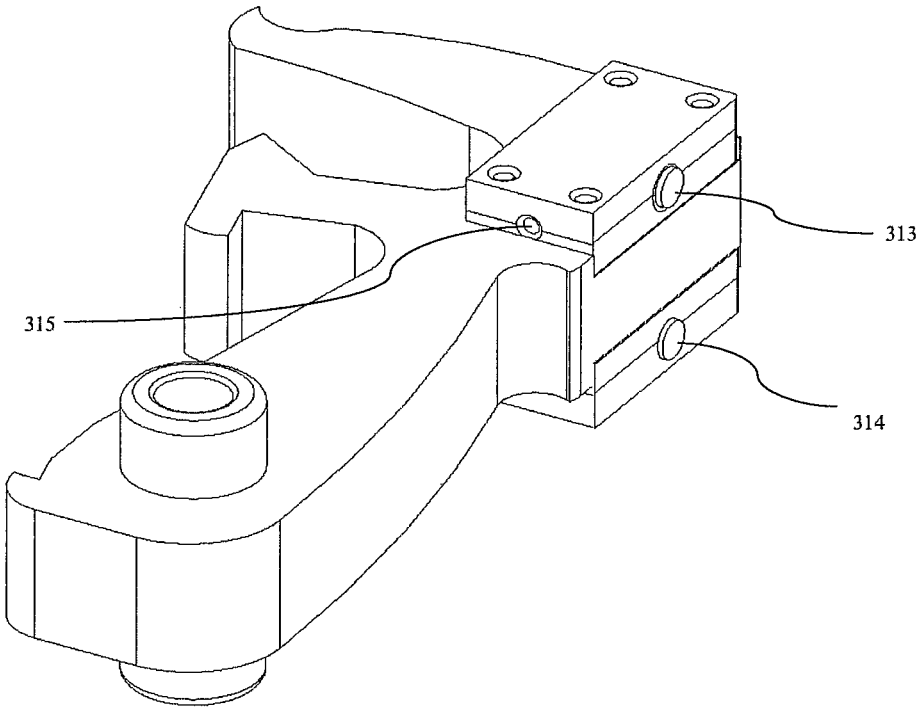

When the fireafin is set to fire in the pure electrical mode the hammer can be locked, as shown in FIG. 3(*a*) by a selector switch (303) with lever locking the hammer (302) in place and the cartridge can be fired using the electronic firing through the chamber. Firing in electrical mode can improve accuracy by eliminating the vibration due to the movement and strike impact of the hammer on the firing pin. The electrical trigger switch is shown with the supply input contact 305 which is connected to the power supply, the output contact 306 is connected to the high voltage generating circuit which in turn is connected to the locking chamber contacts. When the trigger 301 is pulled then the switch spring 307 will close the electrical circuit by pushing the contact 304 to connect the input and output contact ports (305 and 306 respectively).

In FIG. 3(*b*) an alternate electro-mechanical design is shown. Here a combination of two electrical switches activated by the trigger and the hammer respectively is utilized. The mechanical movement of the trigger and the hammer is used to close the electrical circuit and connect the power source like battery (or alternator) to the high-voltage pulse generator circuit thus allowing the single, triple and full auto etc., firing modes achieved in a mechanical arrangement to be also converted into electrical triggers without having to use any sensitive electronic microcontroller/microprocessor control processor and sensor units. In the FIG. 3(*b*) is shown an electrical switch called the hammer switch that is closed whenever the hammer is released. When the trigger is pulled and the hammer is released then the hammer contacts the switch when the hammers projected lower part 312 compresses the switch thereby connecting the contacts 309 and 310 via 308. When the hammer is cocked then the spring 311 with push the connector 308 back breaking the circuit. The switch explained in this diagram is just an example and any electrical switch may be used here. For example, the point 312 in the hammer if made of conducting metal (and properly insulated, to avoid leakage) can be used to connect the points 309 and 310 to complete the circuit whenever the hammer is released; when the hammer is cocked then the points 309 and 310 may be separated by insulation. The points 309 and 310 may be arranged in a plane perpendicular to the hammer point 312. The manufacturers may arrange the Trigger switch and the Hammer switch in parallel, with a selector switch, that separates the electro-mechanical mode and the electrical mode.

In the modern battlefield there is increasing risk of sensitive electronics getting destroyed by E.M.P (Electro Magnetic Pulse) radiation attack thus the use of more robust electro-mechanical arrangement is recommended so that soldiers or law enforcement personnel are not at a disadvantage.

FIG. 3(*c*) shows the perspective view of the Hybrid hammer which is used to apply mechanical strike on the firing pin but can also supply electric power to the cartridge through the bolt. The hybrid hammer is shown having the electrical contacts 308 and 309 placed in the insulated case on either side of the hammer which may act like switch. The port 310 is provided for the insulated connecting wire that supplies the high-voltage electrical power pulse and similarly the return wire is provided on the other side. To use the hybrid hammer the bolt will have to be modified to receive the power from the rear.

Figure 4A:
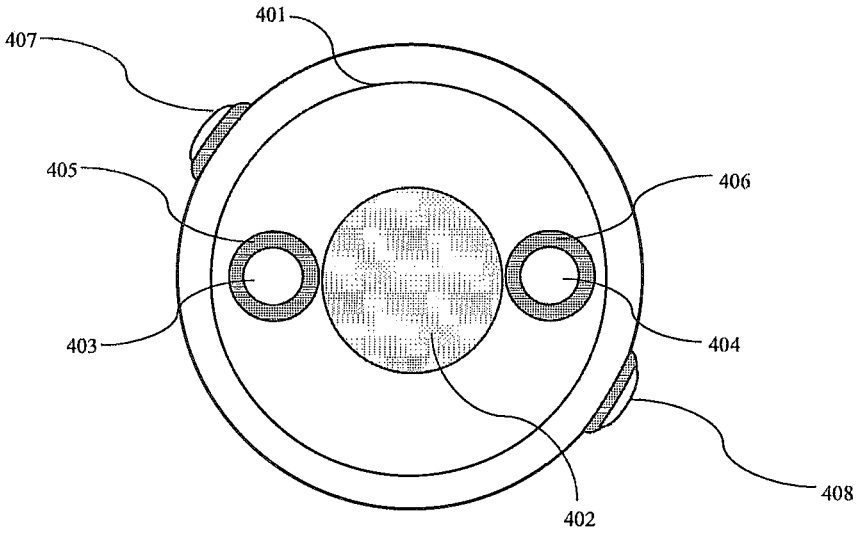
FIG. 4(*a*) shows a bolt's aft designed to receive the electric power supply from a hybrid hammer's contacts so as to receive the power from the hammer and transfer it to the bolt, and FIG. 4(*b*) shows a firing pin which has contacts in the rear (instead of the bolt's aft) to receive electric power via the hybrid hammer and transfer the electric power to the bolt's face or directly to the primer via provisioned hole in the bolt.
Figure 4B:
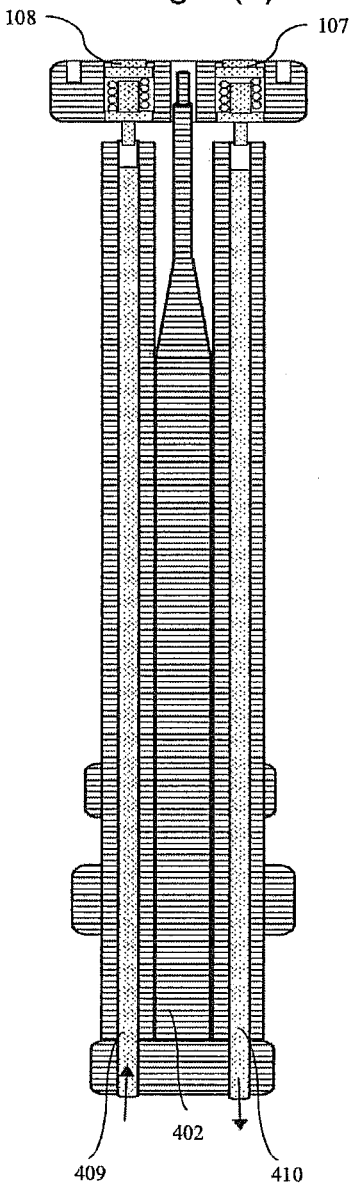

FIG. 4(*a*) shows the aft face of a bolt designed to accept the power supply from the hybrid hammer shown in FIG. 3(*c*). The bolt 401 has the firing pin 402 to strike the chemical-primer; it also has the electric power supply points 403 and 404 which receive the power from the hybrid hammers contacts (313 and 314). The supply points 403 and 404 are surrounded by layer of electrical insulation (shown in shaded pattern as 405 and 406). The bolt can alternately receive the power from the contacts placed on the sides (407 and 408) with the help of hammer or external contacts like a metal brush wherein the external metal brush or contact's power supply is controlled by a CPU or Hammer controlled switch.

The electric power contacts that accept the power from the Hybrid hammer can be either part of the bolt or they may be designed to be part of the firing pin. FIG. 4(*b*) shows a firing pin with electric power contacts (409 and 410) in the rear face capable of receiving power from the hybrid hammer's contacts (313 and 314). When the hammer hits and is pressed against the firing pin then the firing pin's contacts (409 and 410) will be in connection with the bolt's contacts (107 and 108) hence the electric current will flow through these contacts to the primer, triggering the live cartridge. The bolt alternately can have slots that allow the power contacts on either side of the firing pin to directly contact the Hybrid primer's electrodes' base contacts.

Figure 5A:
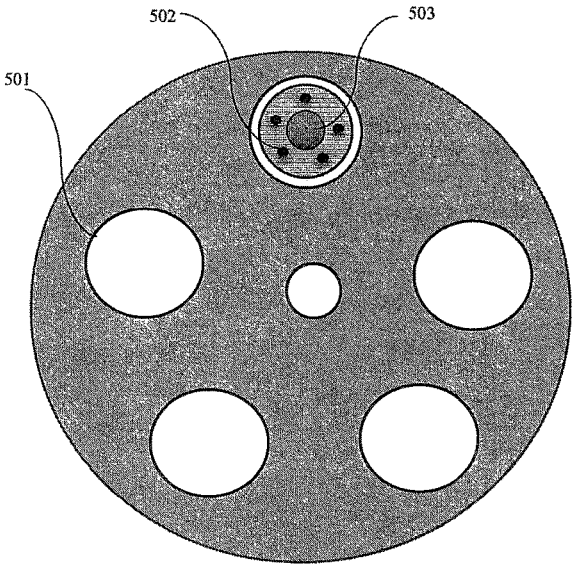
FIG. 5(*a*) shows the rear view of a firearm with a rotating chamber, and FIG. 5(*b*) the front view of a striker which will directly fire the Hybrid primer both mechanically and electrically.
Figure 5B:
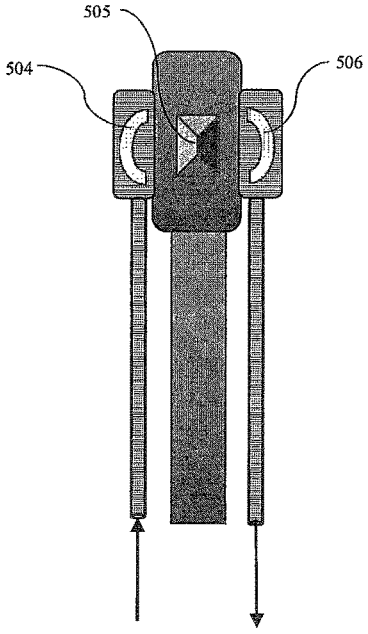

FIG. 5(*a*) shows the back view of a rotating chamber in a firearm with a Hybrid primer cartridge in one of the chambers. The firearms with rotating chamber typically do not have bolt and firing pin instead they have a striker that will directly hit the percussion cap.

FIG. 5(*b*) shows the front view of a striker with the electric power contacts on either side. The pointed edge (505) in the center will strike the percussion cap housing the chemical primer whereas the power contacts (504 and 506) will apply the electric power on the electrode pins and trigger the propellant by creating the electric arcs within the case at multiple trigger points. If the chamber is made of conducting material like metals then the same design can be converted into a one wire system with the chamber connected to the ground. The single or multiple barrel may be fixed (like grenade launcher) or may be part of the chamber rotating together (like Gatling gun).

The firearm will work in the conventional mechanical mode when the electric power supply is disconnected or switched off.

Using the techniques detailed in this application individuals or manufacturers practicing the art of producing firearms can quite comfortably upgrade the existing firearms to fire the electro-chemical Hybrid Primer cartridges.

The invention claimed is:

1. A firearm, modified to trigger a cartridge employing a hybrid primer, comprising:

a firearm chamber;

a hybrid primer cartridge disposed within said firearm chamber and comprising a pair of electrodes and a cartridge case;

an external electrical power supply source;

a locking chamber for locking said hybrid primer cartridge within said firearm chamber, and a pair of locking chamber electrical power supply contacts electrically connected to said external electrical supply source;

a bolt adapted to be disposed within a rear section of said locking chamber; and electrical power contact points mounted upon said bolt and disposed within a rear section of said locking chamber for delivering electrical pulses to said pair of hybrid primer cartridge electrodes from said locking chamber electrical power supply contacts of said locking chamber;

wherein each of said electrical power contacts of said locking chamber comprises at least one movable electrical power contact point, at least one fixed electrical contact point, and a biasing spring normally biasing said at least one movable electrical power contact point out of electrical contact with at least one of said fixed electrical power supply contact points of said locking chamber such that said at least one of said electrical power supply contacts of said locking chamber remains unconnected to said external electrical power supply source unless said bolt is moved to a locked position at which said bolt forces said at least one of said movable electrical power contact points of said locking chamber into contact with at least one of said fixed electrical power supply contact points of said locking chamber whereby current is allowed to flow from said external electrical power supply source, through said electrical power supply contacts of said locking chamber, and through said electrical power contact points of said bolt to said pair of electrodes of said hybrid primer cartridge disposed within said firearm chamber, whereas when said bolt is moved to an unlocked position, said at least one movable electrical power contact point of said locking chamber will be moved, by said biasing spring, back to a position at which electrical contact of said at least one movable electrical power contact point, with said external electrical power supply source, is broken.

2. The firearm as set forth in claim 1, further comprising:

a firing pin disposed within said bolt;

a percussion cap, containing a chemical primer, disposed within one end of said hybrid primer cartridge; and a hammer which is capable of applying electrical power to said electrodes of said hybrid primer cartridge through said bolt as well as mechanically striking said firing pin of said bolt which, in turn, strikes said percussion cap of said hybrid primer cartridge so as to ignite said chemical primer.

3. A firearm as set forth in claim 1, further comprising:

locking lugs, having insulated surface portions and electrical power contact points, disposed upon said bolt such that when said bolt is disposed in its locked position, said locking lugs can receive electrical pulses supplied by said electrical power supply contacts disposed within said locking chamber, and transfer said electrical power to said electrodes of said hybrid primer by means of power contact points which are located upon front face portions of said bolt, and a connecting insulated wire bus;

wherein said electrodes disposed upon said hybrid primer cartridge are disposed in a circular pattern, and said power contact points disposed upon said front face portions of said bolt are disposed in a circular pattern which is similar to that of said hybrid primer cartridge electrodes.

4. The firearm as set forth in claim 1, wherein:

a first wiring system is defined by power supply points disposed within the locking chamber, and a second wiring system is defined by power return or ground points along side portions of said firearm chamber, such that said cartridge case is effectively converted into an electrode that allows current to jump from said primer electrode, which have varying lengths, to said cartridge case and return through said side portions of said firearm chamber, or vice versa depending upon the polarity of electrical power supplied to said electrical power supply contacts of said locking chamber; and wherein distances defined between said primer electrodes and the cartridge case are such that current passes through shorter and longer electrodes thereby creating multiple triggering points inside said cartridge case.

5. The firearm as set forth in claim 2, wherein:

an electrical circuit, wherein said hammer acts as an electrical switch and mechanical movement of said hammer engages said percussion cup, is utilized to close said electrical circuit, allowing current to flow, whereas when said hammer is cocked and disengaged from said percussion cap, said electrical circuit is broken.

6. The firearm as set forth in claim 1, wherein:

said firearm is a rotating chamber firearm having a plurality of firearm chambers defined therein wherein a hybrid primer cartridge is disposed within each one of said plurality of firearm chambers; and a striker is used in conjunction with said rotating chamber firearm which has electrical power supply contacts for applying electrical pulses to said electrodes of said hybrid primer cartridges.

7. The firearm as set forth in claim 3, wherein:

said locking lugs are detachably mounted upon said bolt.

* * * * *